United States Patent [19]

Brennan

[11] 3,972,650

[45] Aug. 3, 1976

[54] SEWAGE SYSTEM

[76] Inventor: Bernard E. Brennan, 16740 Cleveland Road, Granger, Ind. 46530

[22] Filed: Nov. 1, 1974

[21] Appl. No.: 520,156

Related U.S. Application Data

[63] Continuation-in-part of Ser. No. 394,053, Sept. 4, 1973, abandoned.

[52] U.S. Cl. ..... 417/128; 137/418; 137/422; 417/133

[51] Int. Cl.[2] ..... F04F 1/06

[58] Field of Search ..... 137/418, 422; 417/128, 417/130, 133, 134

[56] References Cited

UNITED STATES PATENTS

| | | | |
|---|---|---|---|
| 464,651 | 12/1891 | Cummings | 417/128 |
| 664,183 | 12/1900 | Shone et al. | 417/128 X |
| 1,255,306 | 2/1918 | Gilles | 417/133 |
| 1,437,686 | 12/1922 | Selin | 417/128 |

FOREIGN PATENTS OR APPLICATIONS

| | | | |
|---|---|---|---|
| 6,967 | 7/1933 | Australia | 417/128 |

*Primary Examiner*—Alan Cohan
*Assistant Examiner*—Gerald A. Michalsky

[57] ABSTRACT

A sewage system wherein a sewer line for delivering sewage to a discharge point and a compressed air line extend adjacent to each other. A pluraity of tanks at spaced points and serving to collect sewage from different sources are connected to the sewer line and to the air line. Each connection of a tank with the air line is controlled by a multiple stage valve means which normally vents the tank and prevents air flow to the tank. Each multiple stage valve means includes a pilot valve controlled by float means in the associated tank and a pneumatically activated valve. Check valves are interposed adjacent each tank at the sewage collection and sewage discharge points thereof.

The method of operation of the system entails delivery of sewage to each tank while it is vented to atmosphere and closed to said sewer line and said compressed air line until sewage reaches a selected level in the tank at which the float means actuates the multiple stage valve to close the vent of the tank and deliver air to the tank under pressure sufficient to discharge sewage from the tank into the sewer line. When the contents of the tank lower to a selected level the float means actuates the multiple stage valve to terminate delivery of compressed air to the tank and to again vent the tank to atmosphere.

1 Claim, 9 Drawing Figures

Fig. 1
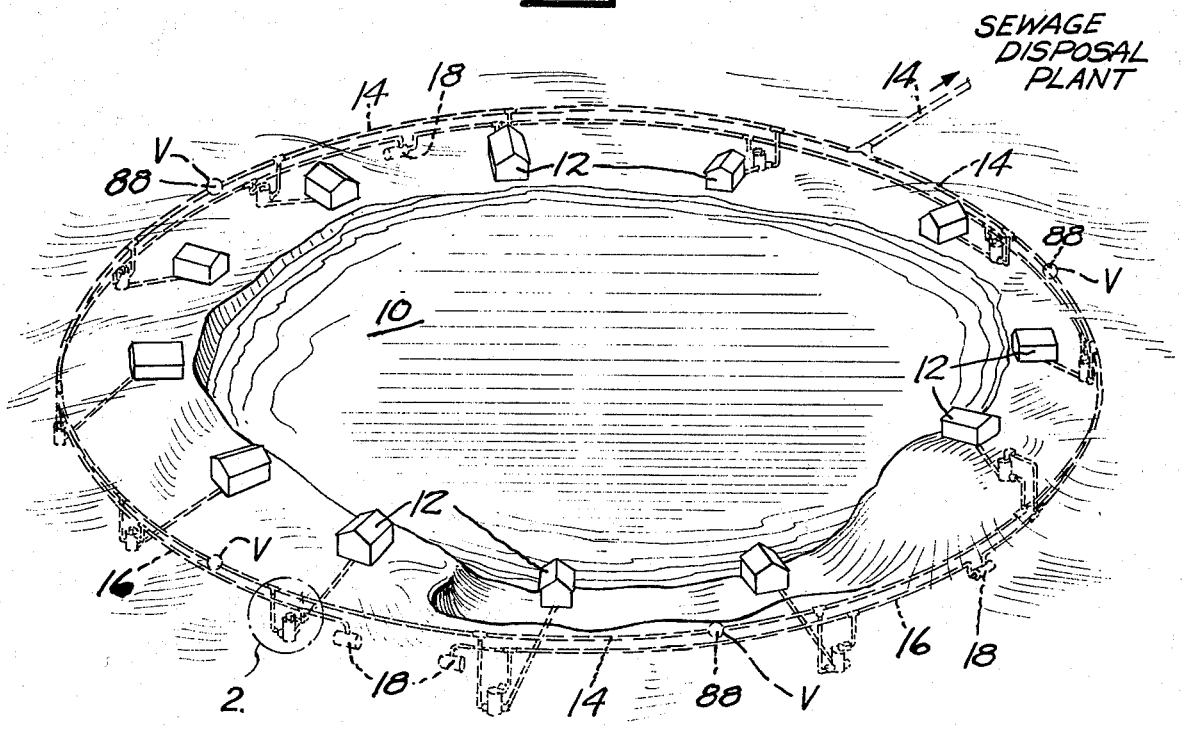
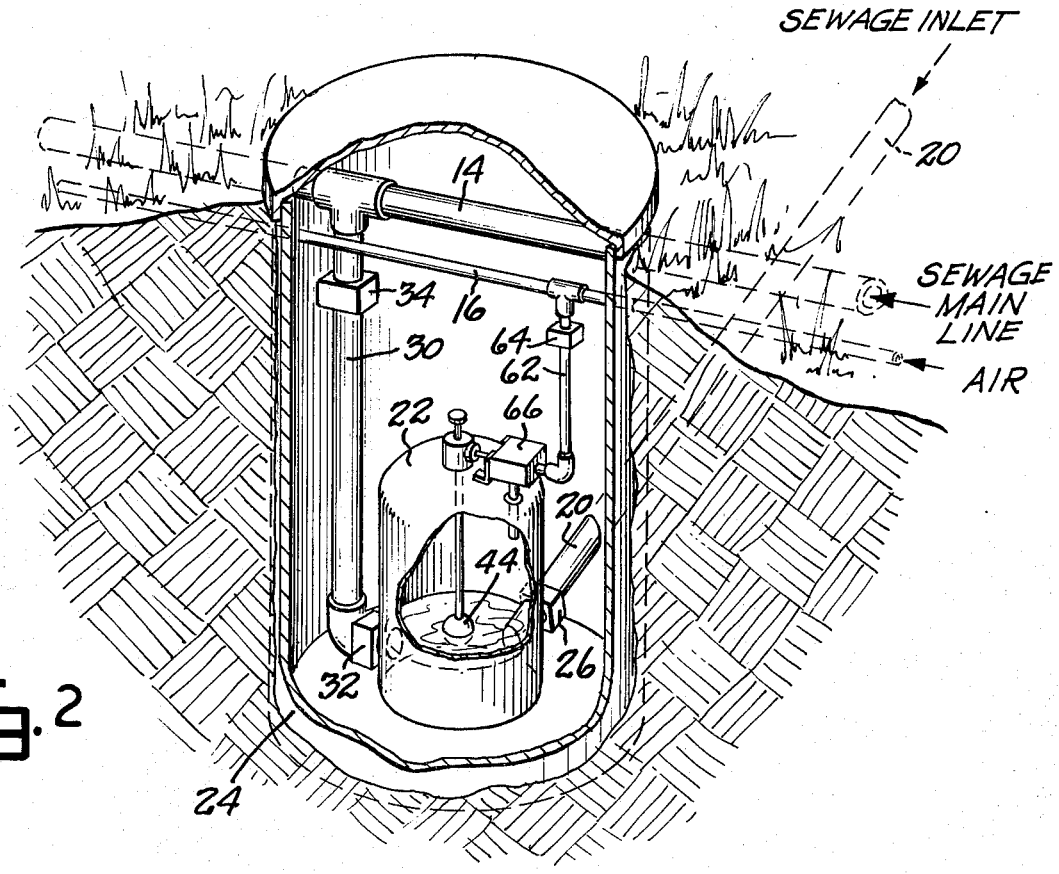
Fig. 2

SEWAGE SYSTEM

This application is a continuation in part of my copending application Ser. No. 394,053, filed Sept. 4, 1973, now abandoned.

The installation of conventional sewage systems in many locations presents problems which are difficult and costly to the extent that they are impractical and hence residents of the area must resort to the use of cesspools with their inherent limitations and disadvantages and the danger of contamination of the ground water supply. Examples of conditions which present such adverse factors are swampy terrain, location of a building at a low level compared to the required or economical location of a sewer line, or rocky conditions which prevent low level installation of sewer lines.

The present system and method contemplates the accumulation of sewage and waste water or industrial waste in a vented tank located adjacent to a residence or other building from whose plumbing system sewage and the like can flow to the tank by gravity, and in which it can be accumulated until a predetermined quantity is collected. The collecting tank has a normally closed low level outlet for connection with a sewage line, and has a normally closed high level connection with a high pressure air line extending adjacent the sewage line. Means responsive to the level of the accumulated sewage in the container are utilized to control multiple stage normally vented and partially air actuated valve means for supplying compressed air to the container to cause evacuation of the waste water and accumulated solids to the sewer line when a selected level thereof in the tank is reached, and for discontinuing supply of air to the air actuated part of the valve and to the tank and venting of the tank to atmospheric pressure when a selected low level of tank content is reached.

The primary object of this invention is to provide a system which is economical to install and operate and which has highly reliable operating characteristics.

A further object is to provide a system of this character wherein a minimum number of air compressors are required.

A further object is to provide a system wherein small diameter air lines, which can be formed of plastic or metal conduit, can be used as air supply means.

A further object is to provide a system of the character which can be used to discharge sewage, waste water and solids into either a force main sewage system or a gravity main sewage system.

A further object is to provide a system in which a plurality of individual air compressors can be used of a type high in quality and having a long operating life to give satisfactory service with minimum failures.

A further object is to provide a system which can be expanded progressively to accommodate connection of additional outlets thereto by adding additional air compressors at different stations in numbers and at rates dependent upon the total requirement of the demands upon the system.

A further object is to provide a system and method of this character which permits a collecting tank to be evacuated rapidly so as to make feasible the use of small capacity collecting vessels at each installation and to ensure that the interval of time during which each unit is out of service due to discharge is maintained at a low level.

Other objects will be apparent from the following specification:

In the drawings:

FIG. 1 is a schematic view of the system used to collect sewage from residences or cottages at a lake.

FIG. 2 is a perspective view with parts broken away illustrating a collecting tank associated with a sewer line and an air supply line.

Figure 3:
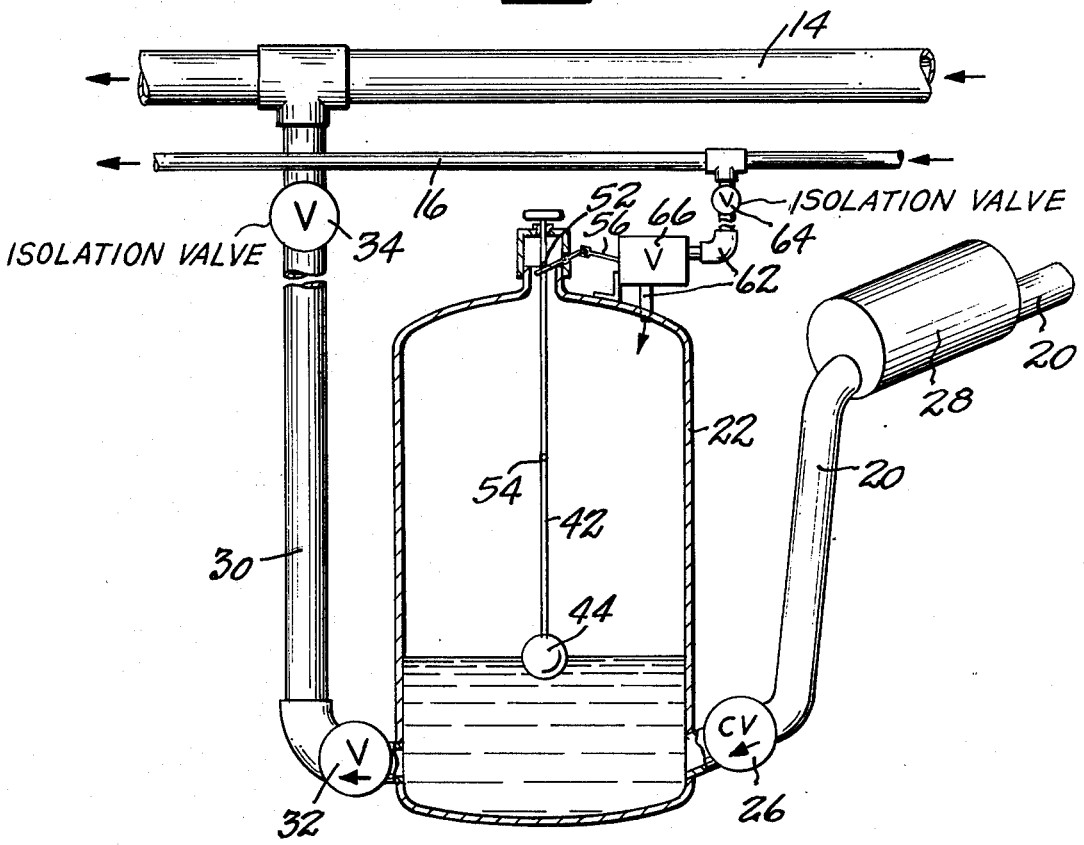
FIG. 3 is a view illustrating a modified embodiment of the system.

Referring to the drawings which illustrate one embodiment of the invention, the numeral 10 designates a lake at which are located a plurality of buildings 12, such as residences, stores, marinas and the like, which are located at different elevations adjacent to the lake, and sewage from which is to be delivered to sewage lines 14 for delivery to a sewage disposal plant or other discharge point. The sewer lines or mains 14 may be either of the gravity type or of the forced main type, which latter type accommodates location of the main at substantially uniform depth relative to the terrain which it traverses and thereby avoids the need for deep installation at some points and shallower installation at other points. In the present instance, the sewer lines 14 can be located at a distance from the lake, as at a road encircling the lake, with some or all of the buildings to be serviced thereby being positioned between the same and the lake, and in many instances being at a lower level than a forced sewer main. Any suitable means (not shown) of conventional character may be utilized in the event a forced main system is entailed for the purpose of advancing sewage through the main to the discharge point. The system also entails the installation adjacent to each sewer line 14 of a compressed air line 16. Each compressed air line will be serviced by one or more air compressors 18 to provide air at selected pressure throughout the line; for example, air at an operating pressure in the order of 100 p.s.i. The location of the air line adjacent to the sewer line is advantageous for economy of initial installation of the two lines, and for convenience in effecting connections necessary for the tanks collecting sewage from individual buildings or groups of adjacent buildings along the main.

The plumbing system of each building 12 is connected to a gravity flow sewage discharge line 20 which leads to a collecting tank 22 located at a sufficiently low level relative to the building to receive sewage flowing by gravity from the plumbing system through the sewage discharge line 20. The collecting tank 22 may be located at any convenient point in relation to the building or buildings 12 to be serviced thereby and to the sewer line 14 and air line 16. Thus, the collecting tank 22 may be located in the basement of a building 12, or in a manhole 24, as illustrated in FIG. 2. A check valve 26 adjacent the connection of discharge line 20 with tank 22 is provided in line 20 to accommodate flow of sewage into the collecting tank 22 and to prevent reverse flow from tank 22 into and through discharge line 20. If desired, an accumulator tank 28 can be connected to the discharge line 20 adjacent to the collecting tank 22 for purposes to be described.

The collecting tank 22 may be formed of any suitable material, such as metal or fiberglass, and preferably will be of a comparatively small capacity, such as 20 to 30 gallons.

A sewage delivery line or conduit 30 is connected to the lower portion of each collecting tank 22 and extends to and connects with an adjacent point of the sewer line or main 14. Delivery line 30 preferably has a check valve 32 interposed therein adjacent to the tank to accommodate flow from the collecting tank 22 to the sewer 14 and prevent reverse flow from line 30 to the tank. The valve 32 will preferably be such as to accommodate passage therethrough of solids of selected size, depending upon the type of waste to be accommodated, and valve 26 also will accommodate such solids. Line 30 also may have an isolation valve 34 interposed therein, preferably adjacent to the sewer line 14, to accommodate manual disconnection of the tank 22 if required. An isolation valve (not shown) may be provided in the sewage discharge line 20.

The collecting tank 22 includes a float mechanism responsive to the level of the waste water and sewage or other contents within the tank. In the form shown, the tank may be provided with a neck 36 at its upper end which is closed by a cap 38 having an aperture therein to receive a guide, such as a sleeve 40, within which is slidable an elongated rigid rod 42. Rod 42 mounts a float or buoyant member 44 at its lower end and a weighted member 46 at its upper end. Cap 38 may have a side opening in which is pivoted at 48 a rod 50 or lever which preferably has a bifurcated inner end fitting around the float rod 42 and adapted for engagement by either of an upper pin 52 or a lower pin 54 carried by the rod 42. The rod or link 50 preferably forms one part of a toggle which includes an outer rod or link 56 having a forked end 58 embracing a pin 60 carried by the outer free end of rod or link 50 or having other means of pivotal connection with rod 50. The pins 52 and 54 are spaced apart so that the upper pin 52 engages the toggle link 50 as the float 44 approaches a selected low level position in the tank 22 as the tank is emptied and shifts the toggle from the full line position in FIG. 4 to the dotted line in that figure. The lower pin 54 is positioned on the float rod 42 at a point to engage the toggle link 50 when in the dotted line position shown in FIG. 4, and to shift the toggle to the full line position in FIG. 4 as the content of the tank approaches capacity, i.e. when float 44 approaches a selected high level position.

A conduit 62 connects the compressed air line 16 to the upper portion of the tank 22 and has interposed therein a selectively actuable isolation valve 64 and a control valve 66 located adjacent to the tank cap 38 to be actuated by the toggle 50–56. The control valve 66 is preferably a multiple-stage valve in which one stage is responsive to the position of the float and the other stage or stages are normally closed and are opened pneumatically under control of the first named stage. Such a valve is shown schematically in FIG. 4 wherein a pilot valve 68, an intermediate valve 78 and a terminal valve 82 are shown. Pilot valve 68 is preferably a three-way valve which is associated with and controlled by the toggle 50–56 and has quick-throw spring-loaded actuating mechanism (not shown). Pilot valve 68 has a connection 70 with conduit 62, a discharge air passage 72 connected to the intermediate valve 78, and a bleed passage 74 which vents to atmosphere at 76. Intermediate valve 78 is normally closed, as by spring means, and is pneumatically actuated to open position by air supplied by passage 72. Valve 78 is connected to air conduit 62 and is adapted to open to direct air therethrough and through a discharge passage 80 to which is connected a third stage valve 82 which is normally closed, as by spring means, and is pneumatically actuated to open position. The intermediate valve 78 is also of the three-way type and has a bleed passage 84 connected to the vent 76. Valve 82, in open position, controls a conduit 86 which forms a part of the air supply line 62 and discharges into the tank 22. Valve 82 in its closed position provides connection of conduit 86 with the vent 76 to atmosphere. The vent 76 preferably includes a filter (not shown) such as activated charcoal.

In the operation of the system, assuming that the isolation valves such as 36 and 64 are open and that the collecting tank 22 is vented to atmosphere through passage 86, valve 82 and vent 76, and assuming that air under selected pressure, such as 100 p.s.i., is available in the line 16 and that the sewer main 14 is conditioned to receive waste water and sewage from each tank 22 and deliver it to a disposal point, the system is ready for operation. As waste water and sewage are discharged by gravity through sewage discharge line or lines 20 connected to one or a group of closely spaced buildings, it flows through the check valve 26 and into the collecting tank 22. At each collecting tank, the operation of the system occurs as the demand thereat dictates. Thus, as each tank 22 fills, the float 44 therein rises, moving upwardly the float rod 42. At this time, the toggle 50–56 will be in the dotted line position illustrated in FIG. 4. As the content of the tank approaches its upper limit or its capacity, the lower pin 54 engages the inner toggle link 50 which is associated with the quick-throw mechanism (not shown) for the pilot valve 68. When the content of the tank reaches a predetermined higher level after initial engagement of pin 54 with arm 50, the toggle 50–56 will be thrown overcenter by the spring (not shown) of the quick-action mechanism.

Figure 4:
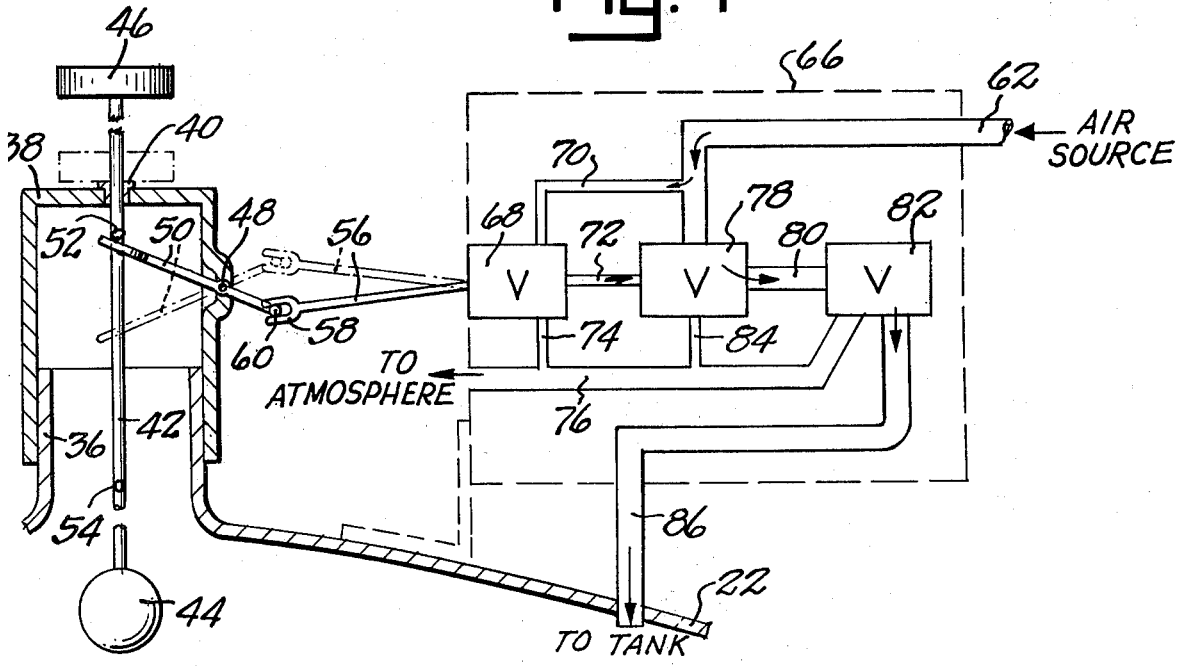
FIG. 4 is a schematic view illustrating a valve control utilized in the system.

When the toggle assumes the full line position of FIG. 4, the pilot valve 68 will be actuated by the spring (not shown) from its normal closed or vented position to an open position in which air from line 62 and inlet passage 70 is directed to and through discharge passage 72 thereof for actuation of the intermediate pneumatically actuated valve 78 from its normal closed or venting position to a position permitting flow of air under pressure therethrough from line 62 to its discharge passage 80 for delivery to the pneumatically actuated valve 82 to shift the position of valve 82 from its normal vented or closed position to an open position for delivery of air under pressure through discharge passage 86 into the tank 22. The air so delivered to the tank 22 is at line pressure, such as 100 p.s.i., and acts upon the content of the tank 22 to discharge it past the check valve 32 through line 30 to the sewer main 14. Such discharge occurs regardless of the relative elevations of the tank 22 and the point of connection of line 30 with the sewer main 14. In other words, sewer main 14 may be at a higher level, at the same level or at a lower level than the point of connection of line 30 and tank 22. The waste discharge includes waste water and solids which are prevented from return through line 20 by the check valve 26.

As the weight of the float unit consisting of float 44, rod 42 and weight 46 causes the unit to lower incident to lowering of the content level in the tank 22, the uppermost pin 52 of the rod 42 engages the free end of the link 50 of the toggle when a predetermined low level condition in the container is approached. Further lowering of the float and its rod actuates the toggle 50 from the full line position in FIG. 4 to a point at which a quick-snap overcenter movement of the toggle to the dotted line position in FIG. 4 occurs, thereby actuating the pilot valve 68. When valve 68 is thus operated, the passage 72 between pilot valve 68 and intermediate valve 78 is opened to the bleed passage 74 and the vent 76. The venting of discharge 72 permits the spring pressed intermediate valve 78 to shift from its open to its normal closed or venting position, thus terminating passage of air from line 62 to passage 80 and establishing communication between passage 80 and bleed passage 84 to the vent 76. The venting of passage 80 leading to the spring pressed pneumatically actuated valve 82 permits that valve to shift to bleed position and establishes air flow from tank 22 through passage 86, valve 82 and the vent 76.

The system will be provided with air at a sufficiently high pressure, such as 100 p.s.i., to ensure that the contents of the container are evacuated rapidly each time the valve 66 opens for delivery of compressed air from line 16 to the tank. Thus a 20 gallon tank can be discharged in a very short period of time, such as 20 or 30 seconds. The air pressure under which discharge occurs is sufficiently great to ensure delivery of the contents of tank 22 through line 30, past check valve 32 and into the sewer main 14, regardless of the elevation of the sewer and regardless of whether the sewer is of the gravity type or of the forced main type. This short interval of time minimizes interruption of service of the plumbing system to which the collecting tank 22 is connected. In order to ensure against malfunctioning of the system and to permit collection of sewage while air pressure holds the check valve 26 closed, an accumulator tank 28 may be provided in line 20 near tank 22, for example, a tank 28 of a capacity in the order of 5 gallons. Accumulator tank 28 receives and stores waste water and sewage until the tank 22 is evacuated and valve 66 vents tank 22 to atmospheric pressure. The location of the point of connection of sewage discharge line 20 with the tank 22 is optional, and preferably will be at an elevation near or higher than the elevation at which contents of tank 22 are operative to actuate valve 66 to supply air to the tank 22.

It will be observed that the system is economical to produce and install, and also enables economical installation of the sewer line and air line, particularly in systems of the forced main type. The elevation of each collecting tank 22 need not be determined in relation to the elevation of the point of the sewer main to which it is connected, but rather is determined solely by a location which permits gravity discharge to the tank 22 from the plumbing system to which it is connected. This minimizes cost of excavation, makes possible in many instances installation of the tank within a basement, and greatly simplifies each installation. Another matter of importance is that the system requires only the connection of the tank 22 to the gravital sewage discharge line 20, to the line 30 leading to the sewer main and to the conduit 62 from the compressed air line. No electric leads are required, and the system operates solely under pneumatic pressure controlled by the level of the contents of the collecting tank as determined by the float and as actuated through mechanical connection of the pilot valve 68 with the float. The supplemental stages of control of the pneumatically actuated valve or valves 78 and 82 follow the actuation of pilot valve 68. It will be understood further that the use of two pneumatically actuated valve 78 and 82 is not necessary in all instances, and that the discharge passage 80 from the valve 78 may lead directly to the tank 22 if desired.

Maintenance and repair of the system is rendered simple by virtue of the fact that the valve 66 can be located conveniently for access, as in a manhole 24 which also affords access to the isolating valves 34, 64, to the check valves 32 and 26, to the valve actuating toggle 50–56 and to the cap 38 and the float assembly.

Repair of the components of the system can be facilitated by the installation of valves 88 in the sewer line at selected points, preferably at or adjacent to bypass lines (not shown) which may connect different parts of the sewer main and may serve areas in the neighborhood but somewhat distant from the portions of the sewer lines in which such valves 88 are located. Similarly, valves (not shown) may be connected in the air line to make possible isolation of a selected portion only of the air line when service at such a section is required or is interrupted for purposes of repair of a component of the system. The system also has the capability of accommodating attachment at a particular collecting vessel of an emergency air compressor in the event a leak in a portion of the air system should develop requiring isolation of that collecting tank, or in the event of a failure in the main air line, or to accommodate connection of an added section of a line or a branch in the system. Another characteristic of the system is that stand-by gasoline engine-driven selectively operable compressors may be provided either in permanent connection or for temporary connection to primary operating compressors 18, such as electrically driven compressors. Such stand by compressors can provide inexpensively for a large group of outlets in the system a reliable secondary air supply without requiring that each collection point be provided with an individual air compressor. Also it will be apparent that, as the requirements for service increase to a point taxing the capacity of the system, additional air compressors may be connected or installed in the air line to increase the capacity of the system. Another advantage of the system is that with a forced main 14 the size of the conduits 14 and 16 may be small.

A self contained or preassembled collection tank may be provided which simplilfies addition of a station in the system. An embodiment of such a preassembled unit is illustrated in FIGS. 5–9 wherein parts similar to the parts in the preceding figures bear the same reference numerals. In this construction, a collecting tank 100 includes a lower portion 102 and an upper portion 104 which are provided with confronting flanges 106 between which a gasket or seal 108 is interposed and which are removably interconnected by bolts or other securing means 110. The lower tank portion has an inlet at which sewage drain line 20 is connected, the line being provided with the check valve 26. Any releasable connection between the tank and the line 20 may be provided. The lower part of the tank 100 is also connected with sewage delivery line or conduit 30 having therein a check valve 32 and also having a detachable connection of any type found suitable.

The upper container part is provided with a bracket 112 having a guide opening therein for slidable reception of the rod 42 which carries a float or buoyant member 44 at its lower end and is provided with a weighted head or member 46 at its upper end. The upper part 104 of the tank also includes a bracket 114 between which and the bracket 112 extends a vertical guide rod 116. A substantially C-shaped member 118 has a vertical aperture fitting around and vertically slidable upon the guide rod 116. A lateral arm 120 projects from the lower end of member 118 and has an aperture therein vertically aligned with the guiding aperture in the bracket 112 to accommodate sliding of the float rod 42 therein and to support that rod at its head 46 in the lowermost position of the float rod illustrated in FIGS. 5, 6 and 7. A second lateral arm on member 118 at its upper end and above the arm 120 provides a stop to limit vertical movement of the float rod 42 relative to the member 118.

Figure 7:
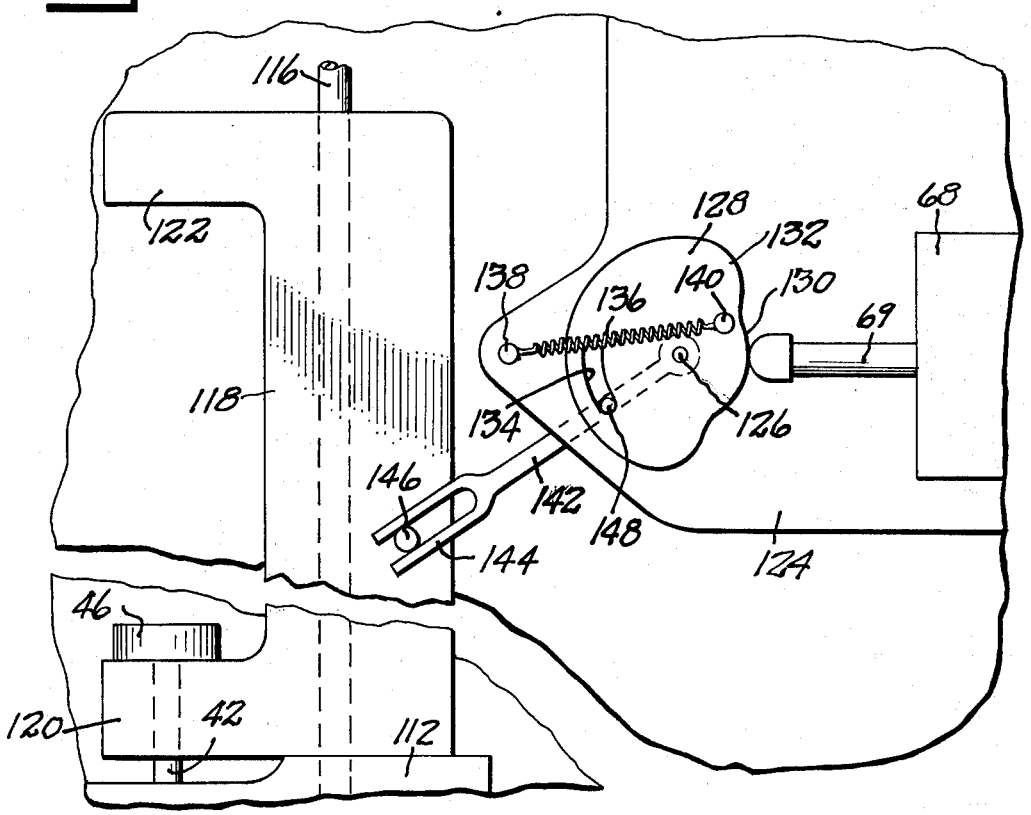
FIG. 7 is an enlarged detail view of the valve operating means in one operating position.
Figure 8:
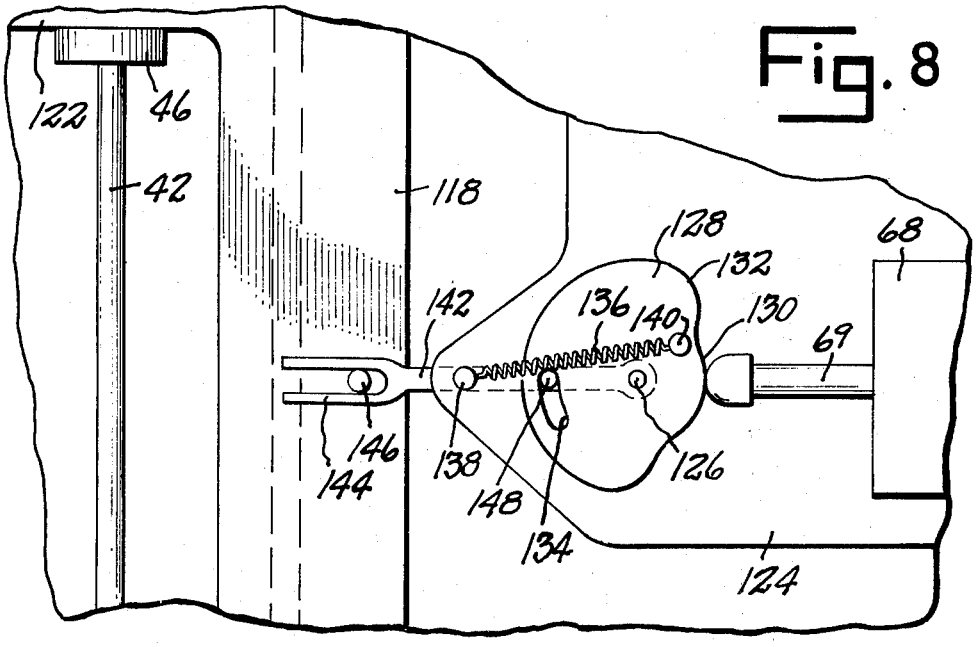
FIG. 8 is an enlarged detail view of the valve operating means in an intermediate position.
Figure 9:
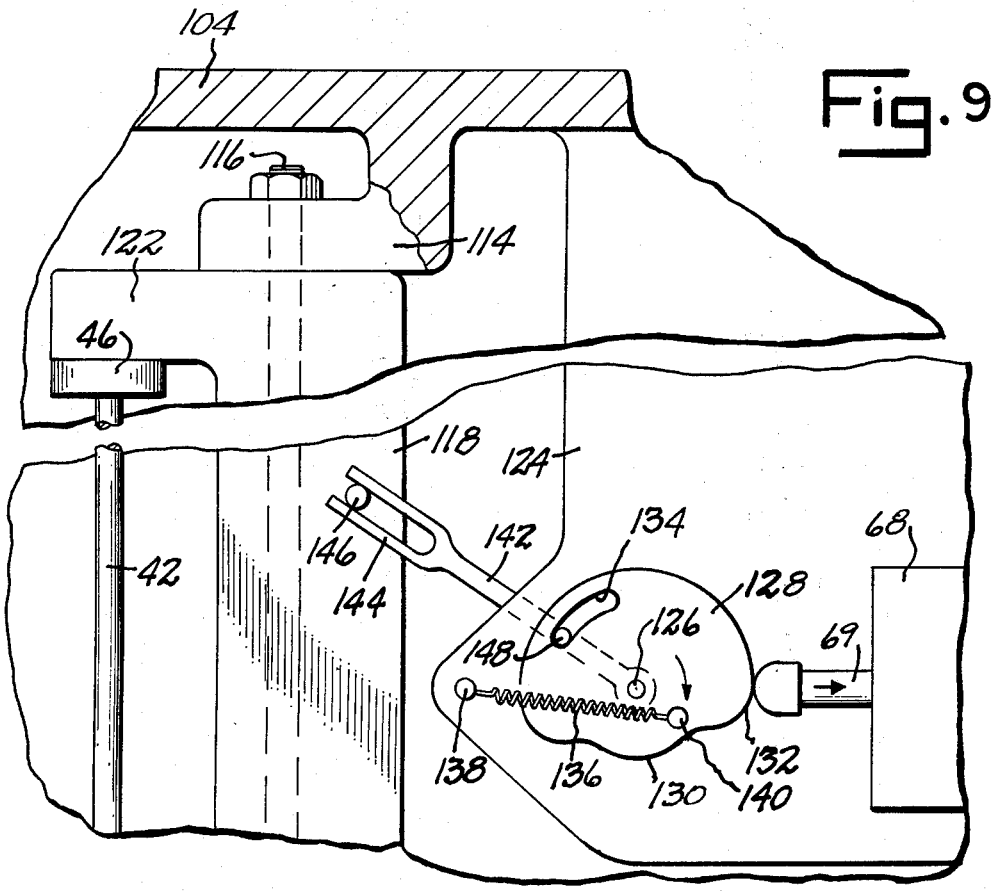
FIG. 9 is an enlarged detail view of the valve operating means in a second operating position.

A bracket or other support 124 is carried by the upper tank portion 104 and has pivotally connected thereto at 126 a cam member 128 having an outer contour or configuration which preferably includes a cam surface 130 spaced slightly from the pivot 126 and a cam lobe 132 in counterclockwise relation to the surface 130, as viewed in FIGS. 7, 8 and 9. Cam 128 is provided with an elongated arcuate slot 134 concentric with pivot axis 126 and substantially diametrically opposed to the cam surface 130. An elongated coil spring 136 is anchored to the bracket 124 at 138 at one spring end and is anchored to the cam 128 at its opposite end at 140 in a position spaced from the pivot axis 126 and between that axis and the junction between the cam surfaces 130 and 132. An elongated arm 142 is pivoted at 26 at the side of cam 128 opposite that along which the spring 136 extends. Arm 142 terminates in a fork end portion 144. A pin or projection 146 on the member 118 is straddled by the fork 144.

The multiple stage valve assembly of the character shown in FIG. 4 and consisting of the valves 68, 78 and 82 is mounted within the upper tank portion 104 in any suitable manner. The pilot valve 68 is provided with a valve plunger 69 spring pressed into contact with the cam 128 to engage either the surface 130 or the cam lobe 132 thereof, depending upon the position of the cam. Compressed air line 62 extends through the upper tank portion 104 and has connection with the spring pressed pneumatically actuated valve 78. Conduit 70 branches from conduit 62 and extends to the pilot valve 68, which also is connected to valve 78 by discharge air passage 72. A passage 80 connects valves 78 and 82 and valve 82 discharges into the tank 86. A vent conduit 76 extends from valve 82 and through the tank wall. A vent passage 84 extends from valve 78 to the vent passage 76 and a vent passage 74 extends from valve 68 to the vent passage 76. Suitable coupling means (not shown) are provided for connection of air line 62 with the air supply line 16 of the system and is preferably provided with the isolation valve 64.

Figure 5:
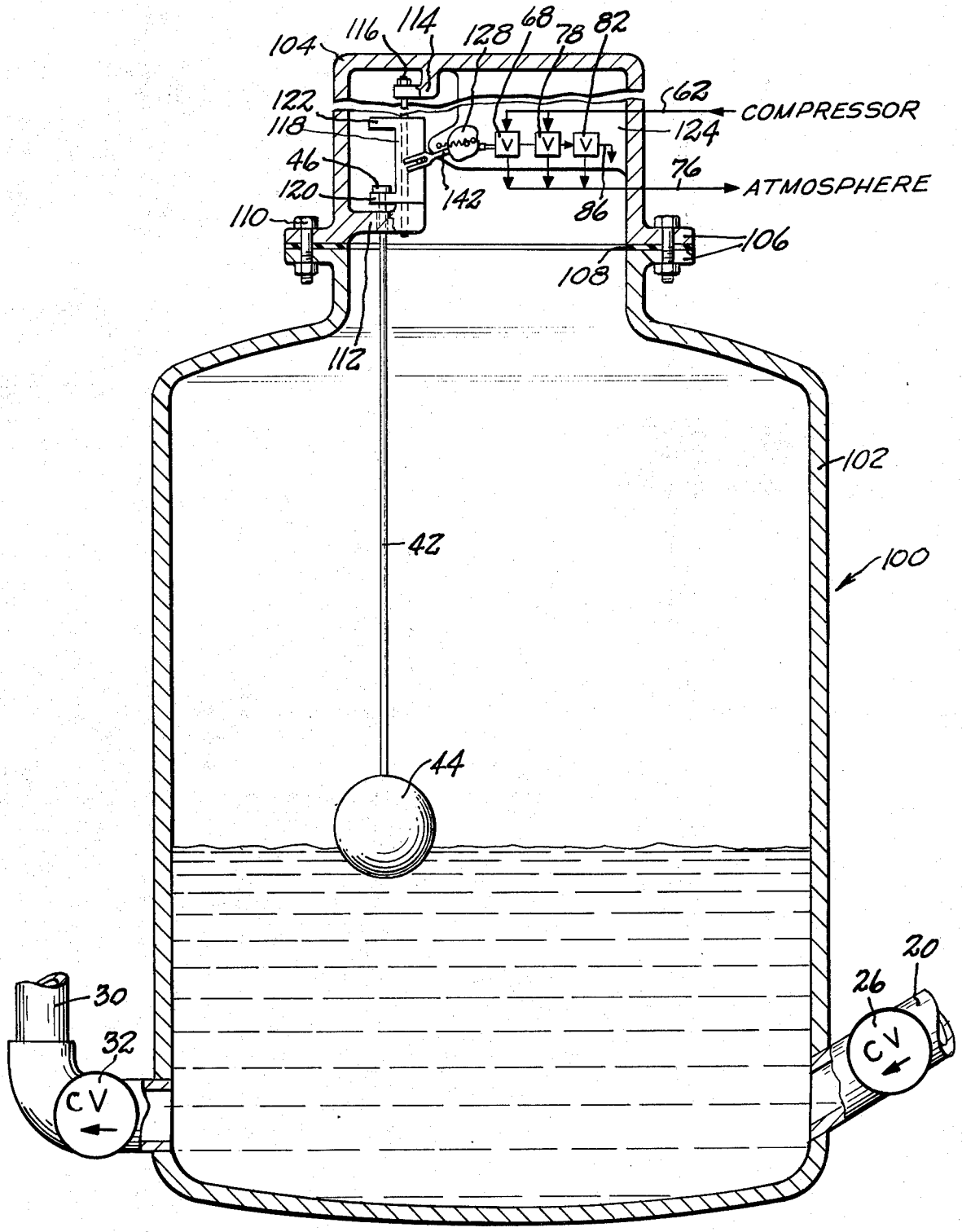
FIG. 5 is a sectional view of another modification with parts shown schematically.
Figure 6:
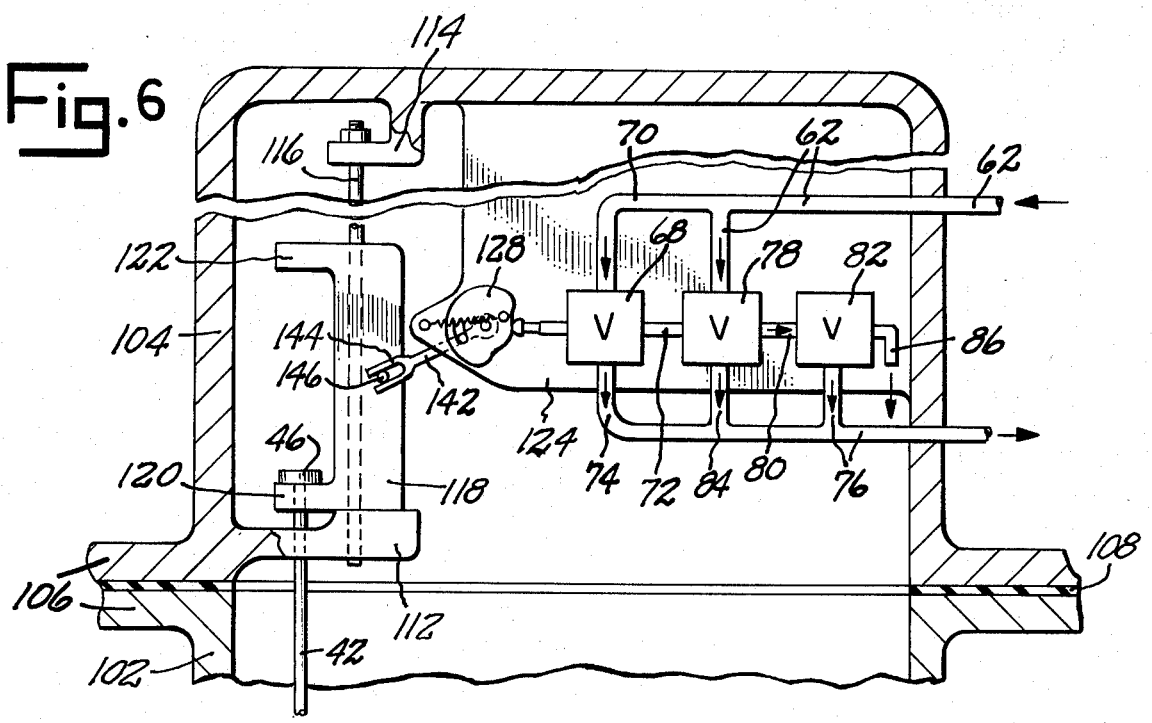
FIG. 6 is an enlarged fragmentary view illustrating the valves and valve control means of the embodiment shown in FIG. 5.

The operation of the system using this type of preassembled collection tank is similar to that described above and is characterized by a quick throw change of the setting of the valves. Thus, assuming that the float 44 is at its lowermost position, as shown in FIGS. 5, 6 and 7, as a starting point, the float 44 will rise as tank 100 is filled. At this time the valves are set in a position to vent the interior of the tank to atmosphere at vent passage 76. It will be noted in FIG. 7 that the member 118 is seated upon the bracket 112 and the cam arm 142 extends angularly downwardly from the cam pivot 126 for engagement of its fork 144 with the pin 146. In this position the spring 136 is positioned above the pivot 126 and a pin 148 on the arm 142 passes through the slot 134 at the lower portion of the slot.

As the tank 100 collects sewage the float 44 rises in the tank relative to the bracket 112 and the C-shaped member 118. When the head 46 on the float rod has traveled a distance substantially equal to the spacing between the lateral arms 120, 122 on the member 118 the head 46 will engage the upper lateral arm 122. Thereafter further upward movement of the head 46 incident to further filling of the tank 100 will entail bodily vertical upward sliding movement of the member 118 which entails upward rocking of the arm 142 about the pivot axis 126 until the pin 148 engages the upper end of the arcuate cam slot 134 at a point intermediate the path of upward travel of the member 118. During this movement, as to the position illustrated in FIG. 8, the cam 128 remains in the starting position shown in FIG. 7 by virtue of the positioning action of the spring 136 thereon.

After the upward travel of the parts 42, 118 and 142 has reached the position shown in FIG. 8, any further upward movement causes clockwise rotation of the cam 128 as viewed in FIG. 8. Such cam rotation serves to lower the spring connection point 140 and when this point passes below the level of the pivot 126 the spring 136 acts to quickly throw the cam 128 to the position illustrated in FIG. 9, at which the cam lobe 132 engages the valve plunger 69 and depresses the same against the action of the spring therein (not shown) to shift the setting of the valve 68 and to open valve 68 for flow of compressed air from line 62 and 70 therethrough to the passage 72 to actuate the intermediate valve 78 against its normal spring closing action and thereby open compressed air line 62 into communication with valve 82 through discharge passage 80 so as to actuate the valve 82 to discharge compressed air at the outlet 86. The aforesaid respective actions of the valves 68, 78 and 82 close the vent line 76. The discharge of air under pressure in the container acts upon the content thereof to discharge the same through the outlet 30.

As the level of the content in the container 100 lowers, the float 40 and the member 118 lower. Such initial lowering from the FIG. 9 position pivots the arm 142 downwardly until pin 148 reaches the lower end of the cam slot 134, whereupon further lowering movement rocks the cam 128 in a counterclockwise direction. When the rocking of the cam 128 is sufficient to permit the spring 136 to pass over-center relative to the pivot axis 126 of the cam, the spring 136 will operate to rock the cam 128 to the position shown in FIG. 7, thus permitting the cam follower 69 of the valve to be projected outwardly by the spring of the valve as it contacts the cam surface 130. This change of the setting of the valve 68 opens the passage 72 into communication with the vents 74 and 76 permitting the spring urged valve 78 to close air line 62 and vent passage 80 at 84 and 76. This action then permits the spring urged valve 82 to shift to connect outlet 86 with vent 76. This action vents tank 100 to accommodate inflow of sewage at inlet 20.

It will be apparent that the preassembled unit shown in FIGS. 5–9 inclusive accommodates all moving parts within the interior of the tank so that any unit can be connected in the sewage system by effecting the connections of the preassembled units with sewage collecting line 20, sewage discharge line 30, and the air compressor line 62. It also eliminates the need to provide stuffing boxes or the like in association with moving parts, and thus minimizes frictional resistance of the parts to movement. This in turn permits use of a small float and minimizes the size of the container and reduces to a minimum the energy required to trip the quick throw mechanism for operating the multi-stage valve. The preassembled unit also has the advantage that the problem of maintaining or sealing air under pressure within the container as required for evacuation of content is minimized, the same being readily effected by suitable connections of the container with intake line 20, discharge line 30 and compressed air line 62, and by the gasket 108 between the parts of the tank. The combination of the construction also provides the advantages of small size and low cost of initial construction and of its connection with the system.

While the preferred embodiments of the invention have been illustrated and described, it will be understood that the scope of the invention is not limited thereto but is to be determined by the following claims.

What I claim is:

1. A preassembled sewage collection unit adapted for connection between a sewage source and a sewage discharge system and with a source of compressed air, comprising a container having sewage inlet and outlet openings, each associated with a check valve, an air inlet connection and an air vent, a multi-stage valve assembly mounted within the upper portion of said container and connected to said air inlet and said air vent, said valve assembly including a pilot valve connected to said air inlet and having a spring urged actuator, a first pneumatically actuated valve connected to said air inlet and responsive to actuation of said pilot valve, and a second pneumatically actuated valve responsive to actuation of said first pneumatically actuated valve for discharging compressed air into the upper portion of said container, each of said valves closing said air inlet connection and open to said vent in response to one operative position of said pilot valve, a cam shiftable in said container between two limit positions and engaged by said pilot valve actuator, a float shiftable in said container in response to the level of sewage therein, and a quick-throw mechanism in said container responsive to variation of the level of the float for shifting said cam from one limit position to the other limit position, said cam being rockable between limit positions and including an elongated arcuate slot, a spring urging said cam to limit position, an elongated arm rockable concentrically of said slot and cam and having a lost motion connection with said float, and a pin carried by said arm and seating in said slot.

* * * * *